US006138336A

United States Patent [19]

Goineau

[11] Patent Number: 6,138,336

[45] Date of Patent: Oct. 31, 2000

[54] HOLOGRAPHIC AIR-JET TEXTURED YARN

[75] Inventor: André M. Goineau, Williamston, S.C.

[73] Assignee: Milliken & Company, Spartanburg, S.C.

[21] Appl. No.: 09/447,731

[22] Filed: Nov. 23, 1999

[51] Int. Cl.[7] ..... D02G 1/16

[52] U.S. Cl. ..... 28/271; 28/220; 57/6; 57/31; 57/908

[58] Field of Search ..... 28/271, 220, 219, 28/247, 258, 246, 272, 273, 274, 275, 276; 58/6, 31, 908, 289, 333, 350, 210, 224, 235, 244

[56] References Cited

U.S. PATENT DOCUMENTS

| | | | |
|---|---|---|---|
| Re. 31,808 | 1/1985 | London et al. | 57/6 |
| 3,354,630 | 11/1967 | Segal | 57/151 |
| 3,355,866 | 12/1967 | Nilson | 57/31 |
| 3,375,579 | 5/1973 | Catlos | 57/155 |
| 3,460,336 | 8/1969 | Collingwood et al. | 57/140 |
| 3,581,486 | 6/1971 | Dibble | 57/22 |
| 3,680,303 | 8/1972 | Kim | 57/157 |
| 3,695,025 | 10/1972 | Gibbon | 57/31 |
| 3,702,055 | 11/1972 | Kosaka et al. | 57/31 |
| 3,724,198 | 4/1973 | Kim | 57/140 |
| 3,883,936 | 5/1975 | Stanley | 28/72.14 |
| 4,433,536 | 2/1984 | O'Neil | 57/233 |
| 4,527,383 | 7/1985 | Bingham | 57/200 |
| 4,697,407 | 10/1987 | Wasserman | 57/238 |
| 4,858,282 | 8/1989 | DuPont, Jr. | 24/143 R |
| 5,379,501 | 1/1995 | Goineau | 28/271 |

*Primary Examiner*—Amy B. Vanatta
*Attorney, Agent, or Firm*—Terry T. Moyer; Earle R. Marden

[57] ABSTRACT

A process to produce a plyed holographic yarn in which the slit film is allowed to be pulled from its source rather than being driven by drive rolls. The slit film and at least one other yarn are plyed and textured in an air texturing jet.

8 Claims, 1 Drawing Sheet

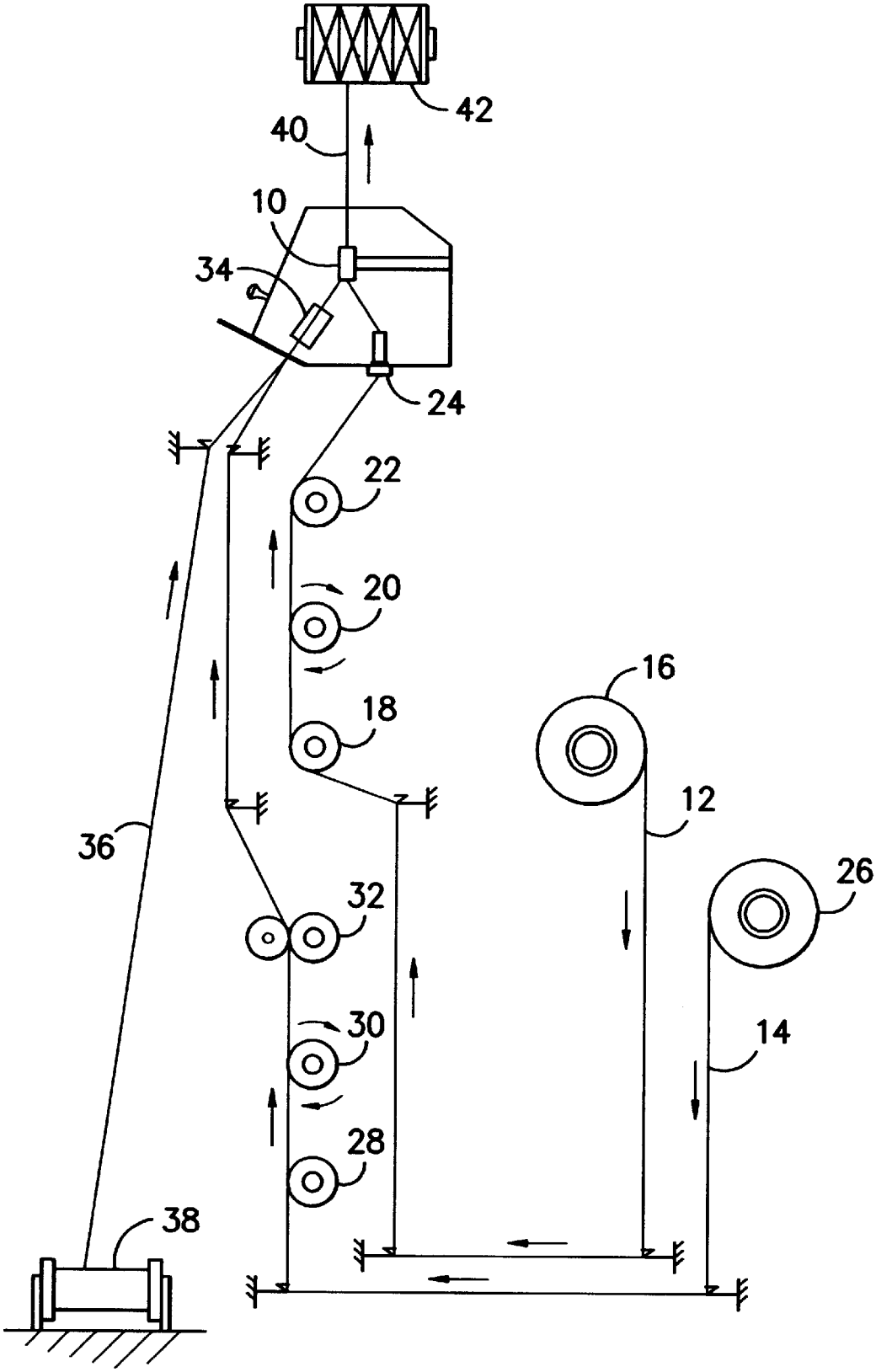
FIG. —1—

HOLOGRAPHIC AIR-JET TEXTURED YARN

This invention relates to a composite yarn structure and a method for making it, and more particularly relates to a yarn structure which comprises a slit film and combined with a yarn which can be bulked thermoplastic fibers, spun yarn and the like.

It has been known in the past that various types of yarns and materials can be combined to produce composite yarn structures which have certain style advantages, especially when the composite yarn structures are formed into a fabric. One type of composite yarn structure which has been produced for purposes of imparting highlights, lusters, and similar style advantages to the yarn and subsequent fabrics has consisted of a metallic film component and a supporting yarn which in some cases has been of thermoplastic material. However, this type of composite yarn has been made in a manner which requires laminating of the metallic film component and is therefore not only difficult to manage but also expensive and time consuming. Furthermore the composite yarn produced has not had suitable breaking strength characteristics. Other types of composite yarn structures have consisted of film components of other materials, such as cellophane or polyester to impart the desired style advantages of highlights and lusters but have not been successful in overcoming the cost and processing disadvantages which have been necessarily employed for imparting the desired style advantages.

Accordingly, it is an object of this invention to provide a composite yarn structure having style advantages of highlights and lusters which can be made by an inexpensive method.

It is another object of this invention to provide a composite structure, one part of which can be dyed and the other part retaining a highlight or luster therein.

It is another object of this invention to provide a composite yarn structure having a light reflective film component which is dye resistant.

It is another object of this invention to provide a method of making a composite light reflective yarn structure which is easily managed and inexpensive.

Generally, the composite yarn structure of this invention includes: a metallized polymeric film component and preferably a thermoplastic yarn. The film is especially prepared and slit in such a manner as to produce a thin film of narrow width, which has a rectangular cross-section. In preparation of the film component of the composite yarn of this invention, care must be taken not to crush the edge so as to thus weaken the film and, accordingly, the composite yarn of this invention.

The film which is employed is bi-axially oriented and is heat set to produce a very stable and strong film which is substantially unreceptive to dyes using normal techniques.

The thermoplastic yarn component of the composite yarn is of either the stabilized or stretch type, depending upon the ultimate properties desired in the fabrics to be produced therefrom.

These and other objects and advantages of the invention will become more apparent from the following detailed description and appended claims taken in conjunction with the accompanying drawings in which: the drawing represents a schematic representation of the preparation of the novel holographic yarn.

In the preferred form of the invention shown in the drawing the yarn formed is an air textured three-ply yarn but it is within the scope of the invention to have two or more plies of yarn along with the slit holographic film which is a metallized polyester film designated 1/69 VS 150 SIL which is 1/69" wide and 2 mils thick. This is basically a slit, silver treated polyester film and is combined in the air texturing jet 10 with an effect yarn 12 and a core yarn 14.

The effect yarn 12, a 150 denier, 68 filament polyester, is delivered from the package 16 at a speed of 139 meters/min. by a drive roll 18. From the drive roll 18 the core yarn is wrapped around a hot pin 20 and drawn by the drive roll 22 pulling the yarn at a speed of 239 meters/min. and delivering it through the guide 24 into the air texturing jet 10.

The core yarn 14, a 150 denier, 68 filament polyester, is pulled off the package 26 by the drive roll 28 at a speed of 123 meters/min. From the roll 28 the core yarn is wrapped around a hot pin 30 and is drawn by the drive roll 32 which is delivering yarn to the jet 10 through the wetting head at a rate of 211 meters/min.

The metallized polyester yarn 36 is pulled off the free-wheeling bobbin 38 by the speed of the take-up yarn 40, which is 192 meters/min. and is delivered through the wetting head 34 into the air texturing jet wherein it is textured and plied with the effect yarn 12 and the core yarn 14 to form the three-ply holographic yarn 40 delivered to the take-up roll 42. As shown the film roll or bobbin 38 is driven by the speed of the yarn 36 being taken up by the take-up roll 42. The resulting yarn is a 3-ply holographic, 528 denier, 137 filament yarn.

It is well known to use holographic films by themselves or ply them between themselves or in combination with other yarns for strength and processability, especially with fine film like 1/69" wide and 2 mils thick. The typical method is twisting. The disadvantage is that the light reflectance of the film is reduced, although processability is greatly improved. By the above-described process we can air-texture a holographic film into a 3-ply yarn. This yarn is made of the film above, a 150 denier 68 filament polyester core and a 150 denier 68 filament polyester effect. Film weakness and static make texturing such film about impossible: it kinks, deforms and breaks (high friction). The film is fed dry by unrolling from a spool directly into the jet with the core yarn wet and the effect polyester ply being conventionally processed.

The film spool is film driven which makes the texturing process feasible, as the film is more rigid than the filaments and cannot bend or overfeed like the filament plies. The resulting "holographic" 3-ply yarn has high reflectance with the film deformation being minimized, yet is locked in and strong making processing downstream into fabric practical.

While the invention has been shown and described with reference to particular embodiments thereof, those skilled in the art will understand that other variations in form and detail may be made without departing from the scope and spirit of our invention.

Having thus described the invention in sufficient detail to enable those skilled in the art to make and use it, I claim as new and desire to secure Letters Patent for:

What is claimed is:

1. A process to manufacture an air textured holographic yarn comprising the steps of: supplying a polymeric multifilament yarn, providing a supply of narrow polymeric film, positively driving the polymeric yarn and drawing same, freely supplying the polymeric film and the drawn polyester yarn into an air texturing jet, plying and texturing said film and said yarn in said air jet and taking up the plied yarn on a take-up which also is supplying the polymeric film into the air jet texturizer.

2. The process of claim 1 wherein said polymeric filament yarn is polyester.

3. The process of claim 2 wherein said narrow polymeric film is metallized polyester.

4. The process of manufacturing a 3-ply holographic yarn comprising: supplying and drawing a core polymeric filament yarn at one speed, supplying and drawing an effect yarn at a speed greater than said core yarn, freely supplying without a drive roll a narrow polymeric film, supplying said yarns and said film into an air texturing jet, air texturing and plying said yarns and said film in said jet and taking up the plied yarns.

5. The process of claim 4 wherein said polymeric films and said core yarn are supplied into a wetting device or "head" prior to the supply of same into said air texturing jet.

6. The process of claim 5 wherein said polymeric filament yarns are polyester.

7. The process of claim 6 wherein said narrow polymeric film is metallized polyester.

8. The product produced by claim 4.

* * * * *